US011821385B2

(12) United States Patent
Doi et al.

(10) Patent No.: US 11,821,385 B2
(45) Date of Patent: Nov. 21, 2023

(54) COVER FOR INTERNAL COMBUSTION ENGINE

(71) Applicant: TOYOTA BOSHOKU KABUSHIKI KAISHA, Aichi-ken (JP)

(72) Inventors: Kensuke Doi, Obu (JP); Yoji Horiuchi, Kariya (JP); Hideto Morishita, Gifu (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/925,353

(22) PCT Filed: Jun. 29, 2021

(86) PCT No.: PCT/JP2021/024625
§ 371 (c)(1),
(2) Date: Nov. 15, 2022

(87) PCT Pub. No.: WO2022/024640
PCT Pub. Date: Feb. 3, 2022

(65) Prior Publication Data

US 2023/0272759 A1 Aug. 31, 2023

(30) Foreign Application Priority Data

Jul. 27, 2020 (JP) ..... 2020-126503

(51) Int. Cl.
*F02F 7/00* (2006.01)
*F02B 67/06* (2006.01)

(52) U.S. Cl.
CPC ..... *F02F 7/00* (2013.01); *F02B 67/06* (2013.01)

(58) Field of Classification Search
CPC ..... F02B 67/06; F02B 77/00; F02F 7/00
See application file for complete search history.

(56) References Cited

U.S. PATENT DOCUMENTS 6,213,073 B1 * 4/2001 Iwata ..... F16H 7/0836 123/90.31
11,548,604 B1 * 1/2023 Misorski ..... B63H 21/38
(Continued)

FOREIGN PATENT DOCUMENTS

JP 6-146915 5/1994

OTHER PUBLICATIONS

Official communication cited in International Patent Application PCT/JP2021/024625, dated Sep. 7, 2021, along with English translation thereof.

*Primary Examiner* — John Kwon
(74) *Attorney, Agent, or Firm* — GREENBLUM & BERNSTEIN, P.L.C.

(57) ABSTRACT

A chain cover includes a first member, which is made of a hard plastic, and a second member, which is made of a material different from the hard plastic. The first member is formed by insert molding with the second member as an insert. A first joint surface is formed in a peripheral portion around an insertion hole. The first joint surface is joined to the first member. The first joint surface includes a first joint portion, which includes a lattice-shaped recess portion, and a second joint portion, which includes grooves. The grooves extend in a direction in which the peripheral portion extends, while being arranged in an intersecting direction, which intersects with the extending direction. The second joint portion is provided to be closer to a space adjacent to the peripheral portion than the first joint portion.

4 Claims, 5 Drawing Sheets

(56) References Cited

U.S. PATENT DOCUMENTS

| | | | | |
|---|---|---|---|---|
| 11,668,233 | B2 * | 6/2023 | Sarder | F02B 63/044 123/3 |
| 2001/0008818 | A1 * | 7/2001 | Tawa | F02M 35/167 440/76 |
| 2022/0154637 | A1 * | 5/2022 | Doi | F02F 7/0073 |

* cited by examiner

COVER FOR INTERNAL COMBUSTION ENGINE

TECHNICAL FIELD

The present disclosure relates to a cover for an internal combustion engine that is configured to be attached to an engine main body and cover a timing chain or a timing belt.

BACKGROUND ART

Patent Literature 1 discloses a plastic timing belt cover for an internal combustion engine. The timing belt cover includes a plastic outside cover and a plastic inside cover. The inside cover is located between the outside cover and an engine main body. A timing belt is accommodated between the inside cover and the outside cover.

The timing belt cover includes a soundproofing portion, which is an elastic member made of, for example, a thermoplastic elastomer.

The soundproofing portion is accommodated in the timing belt cover in the vicinity of a tensioner pulley, which is arranged between a crank timing pulley and a cam timing pulley.

The soundproofing portion is molded continuously with the outside cover through injection molding when the outside cover is manufactured.

CITATION LIST

Patent Literature

Patent Literature 1: Japanese Laid-Open Patent Publication No. 6-146915

SUMMARY OF INVENTION

Technical Problem

The timing belt cover disclosed in Patent Literature 1 includes a portion at which the plastic outside cover and the soundproofing portion, which is an elastic member made of, for example, a thermoplastic elastomer, are joined to each other. There is a demand for an improvement in the joint strength of the members and the sealing performance at the joined portion.

Such a problem is not caused only at the joined portion of an outside cover and a soundproofing portion, but also at a joined portion of members made of different materials. Further, such a problem is not caused only in the timing belt cover for an internal combustion engine, but also in a timing chain cover.

It is an objective of the present disclosure to provide a cover for an internal combustion engine that improves the joint strength and the sealing performance at a joined portion of members made of different materials.

Solution to Problem

In order to achieve the foregoing objective, a cover for an internal combustion engine is provided. The cover is configured to be attached to an engine main body and cover a timing chain or a timing belt. The cover includes a first member made of a hard plastic, and a second member made of a material different from the hard plastic. The first member is formed by insert molding with the second member as an insert. The second member includes a joint surface in a periphery of the second member. The first member is joined to the joint surface. The joint surface includes a first joint portion and a second joint portion. The first joint portion includes a lattice-shaped recess portion. The second joint portion includes grooves. The grooves extend in an extending direction in which the periphery extends. The grooves are arranged in an intersecting direction that intersects with the extending direction. The second joint portion is provided to be closer to a space adjacent to the periphery than the first joint portion.

According to this configuration, when the first member is formed by insert molding with the second member as an insert, the recess portion of the first joint portion and the grooves of the second joint portion, which are formed in the joint surface of the second member, are filled with molten plastic. Since the recess portion has the shape of a lattice, a large contact area is ensured between the first joint portion and the first member. This increases the joint strength of the first member and the second member.

Generally, blow-by gas in an internal combustion engine and oil splashed from an engine main body are likely to infiltrate into a cover that covers a timing chain or a timing belt through small gaps between a first member and a joint surface of a second member.

In this regard, the second joint portion is provided to be closer to the space adjacent to the periphery than the first joint portion in the above-described configuration. Further, the grooves of the second joint portion are arranged along the intersecting direction, which intersects with the extending direction of the periphery of the second member. This prevents blow-by gas or oil in the internal combustion engine from infiltrating through the small gaps between the joint surface of the second member and the first member. This improves the sealing performance between the first member and the second member. Since the sealing performance is improved at the second joint portion, blow-by gas or oil in the internal combustion engine are prevented from infiltrating into the first joint portion. The joint strength at the first joint portion is thus maintained. Accordingly, the joint strength and the sealing performance at a joined portion of members made of different materials are improved.

DESCRIPTION OF EMBODIMENTS

A cover for an internal combustion engine according to an embodiment will now be described with reference to FIGS.

1 to 8. In the present embodiment, a timing chain cover (hereinafter, referred to as a chain cover) of the present disclosure is attached to a reciprocating (piston-type) internal combustion engine mounted on a vehicle.

Figure 1:
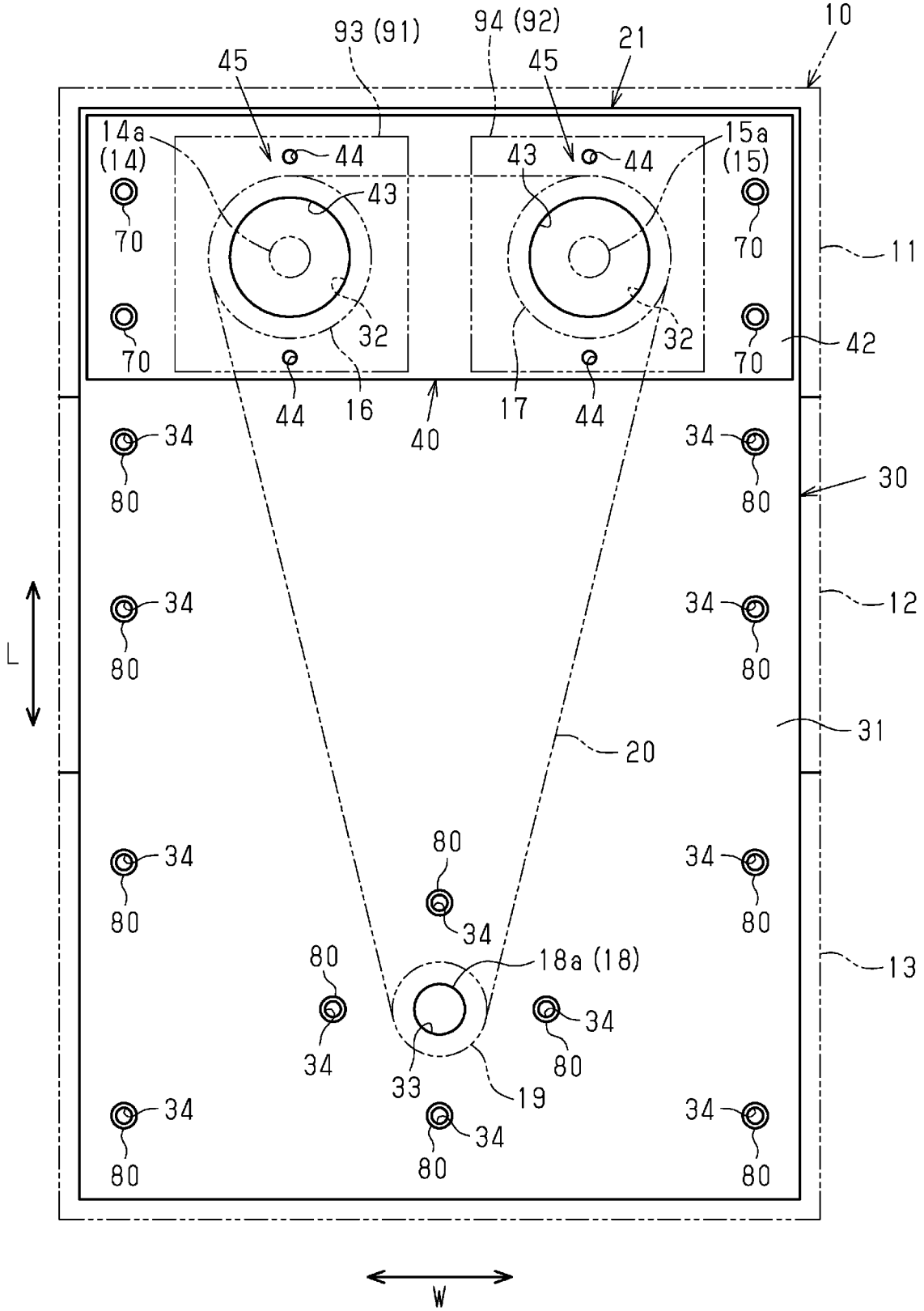
FIG. 1 is a front view of a chain cover for an internal combustion engine according to an embodiment, illustrating the chain cover attached to an engine main body.

As shown in FIG. 1, the internal combustion engine includes an engine main body 10 and a chain cover 21, which is attached to the engine main body 10.

Engine Main Body 10

As shown in FIG. 1, the engine main body 10 includes a cylinder head 11, a cylinder block 12, and a crankcase 13. The cylinder block 12 is disposed between the cylinder head 11 and the crankcase 13.

The cylinder head 11 rotatably supports an intake camshaft 14 and an exhaust camshaft 15.

The intake camshaft 14 and the exhaust camshaft 15 respectively open and close intake valves (not shown) and exhaust valves (not shown), which are engine valves.

The camshafts 14, 15 include ends 14*a*, 15*a* on one side in an extending direction of the camshafts 14, 15. The ends 14*a*, 15*a* protrude from the cylinder head 11.

Motor-driven variable valve timing mechanisms 91, 92 are respectively coupled to the ends 14*a*, 15*a* of the camshafts 14, 15.

The variable valve timing mechanisms 91, 92 respectively include motors 93, 94 and actuators (not shown), which include speed reduction mechanisms and link mechanisms.

The actuators of the variable valve timing mechanisms 91, 92 respectively include driven sprockets 16, 17.

The crankcase 13 rotatably supports a crankshaft 18. The crankshaft 18 includes an end 18*a* in an extending direction. The end 18*a* protrudes from the crankcase 13. The end 18*a* protrudes in the same direction as the ends 14*a*, 15*a* of the camshafts 14, 15.

A drive sprocket 19 is coupled to the end 18*a* of the crankshaft 18.

A timing chain 20 is looped over the driven sprockets 16, 17 and the drive sprocket 19. The driven sprockets 16, 17 are configured to rotate in conjunction with rotation of the drive sprocket 19 by means of the timing chain 20. Rotational force of the crankshaft 18 is thus transmitted to the camshafts 14, 15.

The intake-side variable valve timing mechanism 91 controls the rotation speed of the motor 93 so as to vary the rotational phase of the intake camshaft 14 relative to the driven sprocket 16.

The exhaust-side variable valve timing mechanism 92 controls the rotation speed of the motor 94 so as to vary the rotational phase of the exhaust camshaft 15 relative to the driven sprocket 17.

Controllers (not shown) are respectively integrated with the motors 93, 94.

Chain Cover 21

As shown in FIG. 1, the chain cover 21 is configured to be attached to the engine main body 10 and cover the timing chain 20.

The chain cover 21 includes a first member 30, which is made of a hard plastic, and a second member 40, which is made of a material different from the hard plastic.

The chain cover 21 of the present embodiment has a rectangular shape in front view.

In the following description, the direction along the long sides of the chain cover 21 (the up-down direction as viewed in FIG. 1) will be referred to as a longitudinal direction L, and the direction along the short sides (the lateral direction as viewed in FIG. 1) of the chain cover 21 will be referred to as a width direction W.

The chain cover 21 includes tubular collars 70, which receive bolts (not shown) for attaching the chain cover 21 to the engine main body 10.

Figure 2:
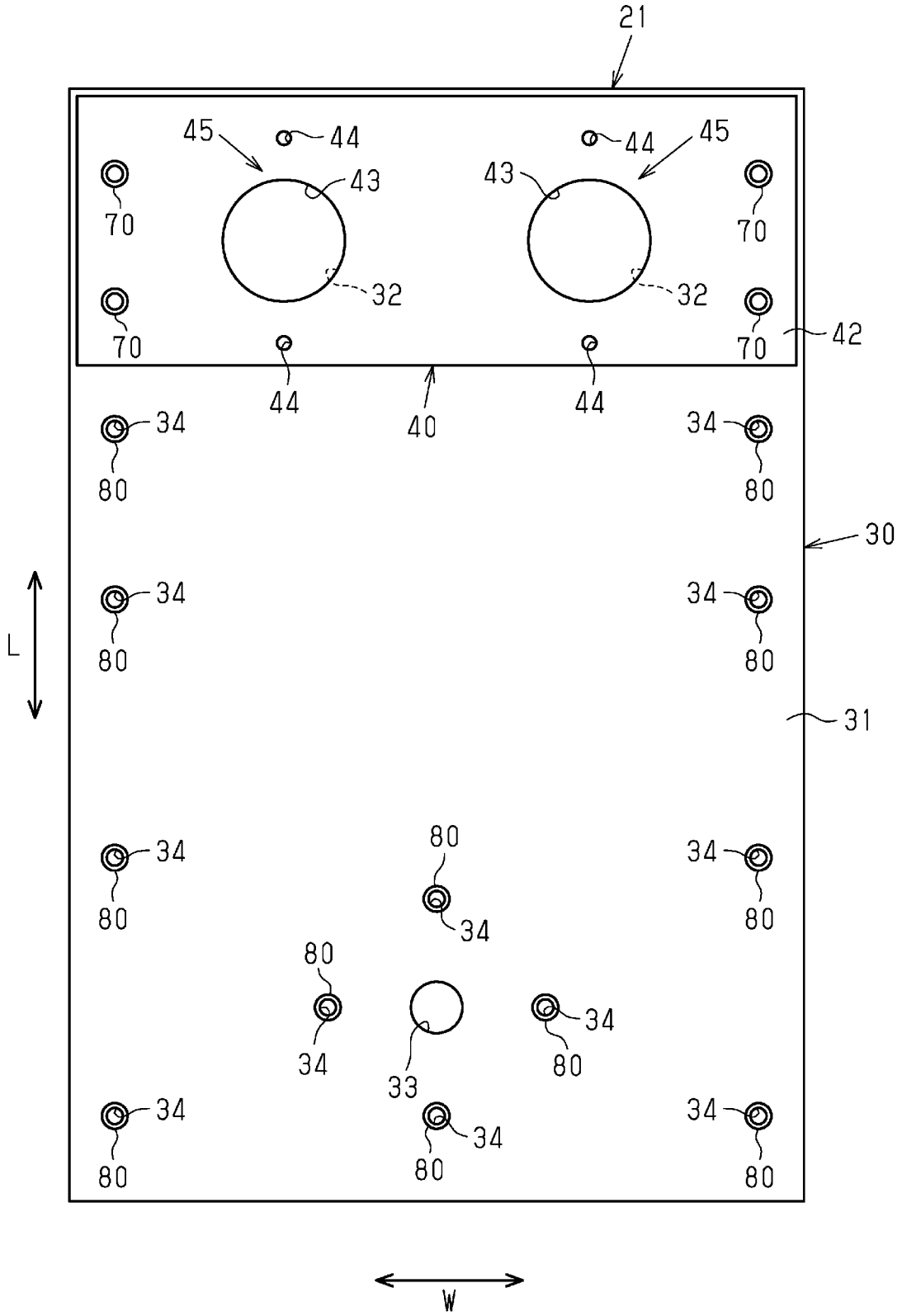
FIG. 2 is a front view of the chain cover according to the embodiment.

As shown in FIGS. 1 and 2, the first member 30 has a rectangular shape in front view and forms an outer peripheral edge of the chain cover 21. The second member 40 is joined to a part in the longitudinal direction L of a front face 31 of the first member 30 (upper portion as viewed in FIGS. 1 and 2). The second member 40 has a rectangular shape that is elongated in the width direction W in front view.

First, the first member 30 will be described.

As shown in FIGS. 1 and 2, the first member 30 includes two insertion holes 32, which respectively receive the motors 93, 94, in a portion that is covered with the second member 40 (upper portion as viewed in FIGS. 1 and 2). The two insertion holes 32 are spaced apart from each other in the width direction W.

The first member 30 has a through-hole 33, through which the crankshaft 18 extends, in a portion that is not covered with the second member 40 (lower portion as viewed in FIGS. 1 and 2).

The first member 30 has fastening holes 34 in the portion that is not covered with the second member 40. Each fastening hole 34 receives a metal collar 80.

Each of the side sections in the width direction W of the chain cover 21 is provided with four of the fastening holes 34 in the present embodiment. In each side section, the four fastening holes 34 are spaced apart from each other in the longitudinal direction L. Also, four of the fastening holes 34 are arranged around the through-hole 33. In FIG. 1, bolts inserted into the fastening holes 34 are omitted.

The first member 30 is made of a hard plastic. In the present embodiment, the first member 30 is made of a plastic that has polyamide (PA-6GF) as a major component.

The second member 40 will now be described.

Figure 3:
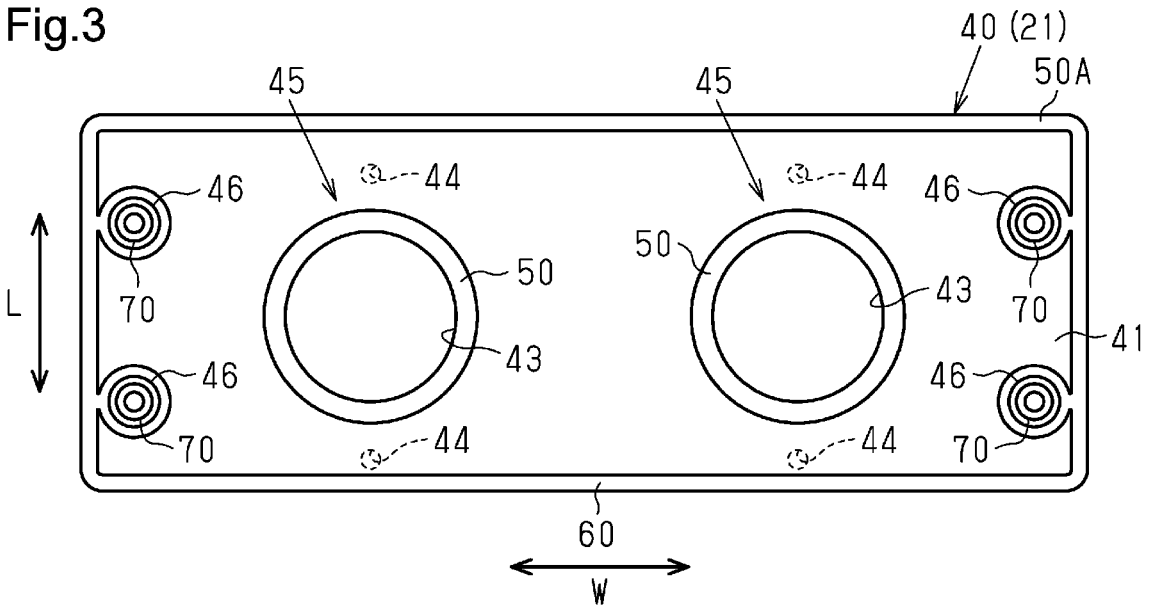
FIG. 3 is a rear view of a second member of the chain cover according to the embodiment.

As shown in FIGS. 1 to 3, the second member 40 includes a back face 41, which is joined to the front face 31 of the first member 30, and a front face 42, which is located on a side opposite to the back face 41.

As shown in FIGS. 1 and 2, the second member 40 includes two insertion holes 43, which respectively receive the motors 93, 94. The two insertion holes 43 are spaced apart from each other in the width direction W. Each insertion hole 43 is continuous with the corresponding insertion hole 32 of the first member 30.

The motors 93, 94, with which the controllers are integrated, are attached to the front face 42 of the second member 40.

As shown in FIGS. 1 to 3, the second member 40 has attachment holes 44 in a peripheral portion 45 around each insertion hole 43. Bolts (not shown) for attaching the motors 93, 94 to the second member 40 are threaded into the attachment holes 44. The attachment holes 44 correspond to attachment portions according to the present disclosure.

As shown in FIG. 3, the second member 40 has tubular portions 46 protruding from the back face 41. The tubular portions 46 respectively surround the collars 70. As shown in FIG. 3, each of the side sections in the width direction W of the back face 41 is provided with two of the tubular portions 46 in the present embodiment. In each side section, the two tubular portions 46 are spaced apart from each other in the longitudinal direction L.

The second member 40 is made of a hard plastic that has a lower coefficient of linear expansion and a lower water absorbency than the hard plastic forming the first member 30. In the present embodiment, the second member 40 is made of polyphenylene sulfide (PPS-GF).

The second member 40 is formed by insert molding with the collars 70 as inserts.

The first member 30 is formed by insert molding with the second member 40 and the collars 80 as inserts.

As shown in FIG. 3, the back face 41 of the second member 40 includes first joint surfaces 50 and a second joint surface 60, which are joined to the first member 30.

The first joint surfaces 50 are respectively formed in the peripheral portions 45 about the insertion holes 43. In the present embodiment, each first joint surface 50 is formed over the entire corresponding peripheral portion 45. Each first joint surface 50 corresponds to a joint surface according to the present disclosure. Also, the peripheral portion 45 around each insertion hole 43 corresponds to a periphery of the second member 40 according to the present disclosure.

Figure 4:
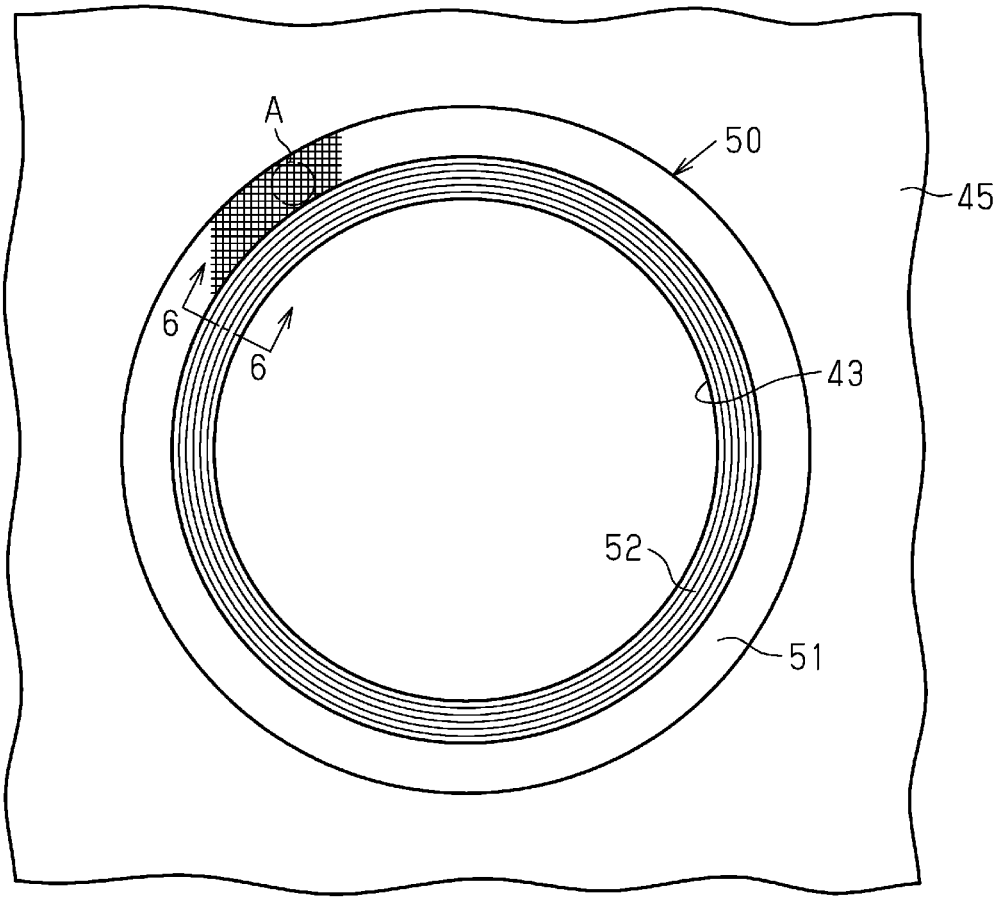
FIG. 4 is an enlarged rear view of an insertion hole of the second member.
Figure 5:
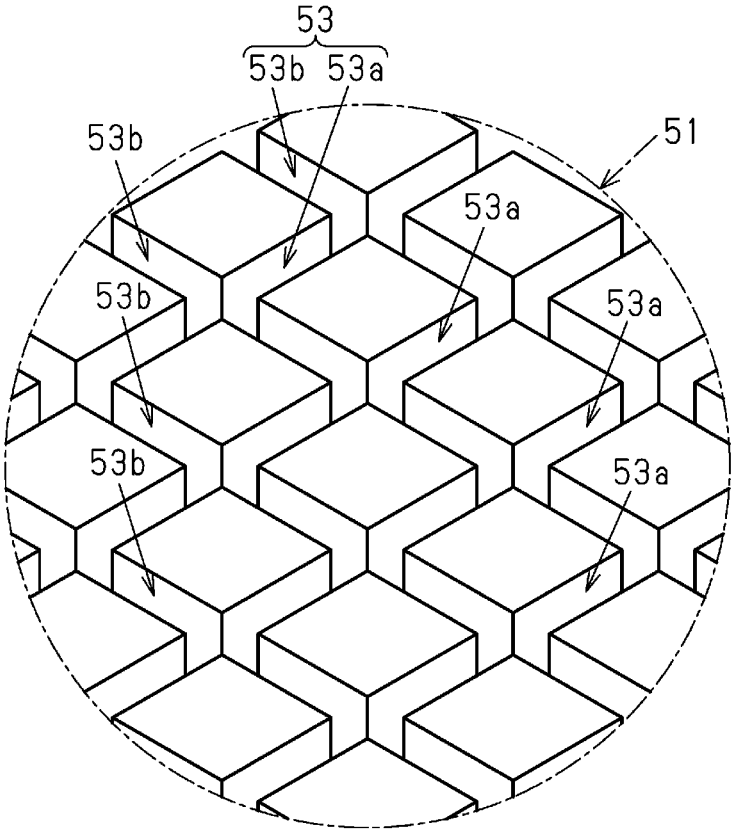
FIG. 5 is an enlarged perspective view of part A in FIG. 4.
Figure 6:
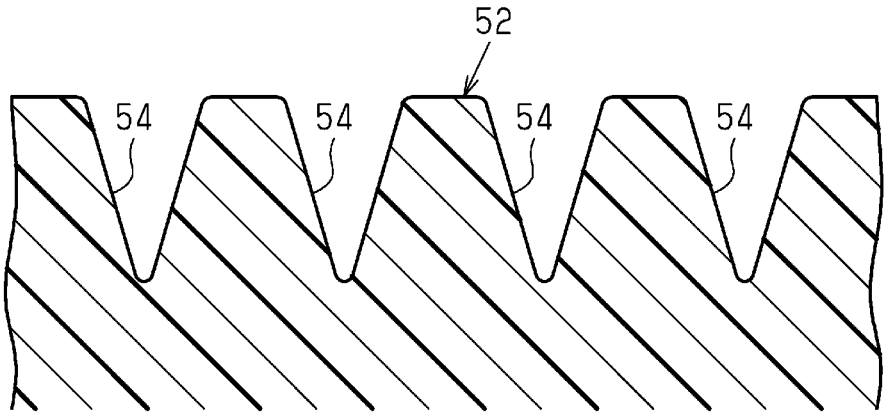
FIG. 6 is a cross-sectional view taken along line 6-6 of FIG. 4.

As shown in FIGS. 4 to 6, each first joint surface 50 includes a first joint portion 51, which includes a lattice-shaped recess portion 53, and a second joint portion 52, which includes grooves 54. The grooves 54 extend in a direction in which the peripheral portion 45 extends, that is, in the circumferential direction of the insertion hole 43, while being arranged in a direction perpendicular to the extending direction, or in the radial direction of the insertion holes 43. The recess portion 53 and the grooves 54 are formed, for example, by a laser device.

As shown in FIG. 4, the first joint portion 51 and the second joint portion 52 are provided over the entire peripheral portion 45.

The second joint portion 52 is provided to be closer to the insertion hole 43 than the first joint portion 51. That is, the second joint portion 52 is provided to be closer to the space adjacent to the peripheral portion 45 than the first joint portion 51.

As shown in FIG. 5, the recess portion 53, which forms the first joint portion 51, includes first grooves 53*a*, which extend in parallel, and second grooves 53*b*, which are orthogonal to the first grooves 53*a*.

As shown in FIG. 3, the second joint surface 60 is formed in the peripheral edge of the second member 40 and the end faces of the tubular portions 46. In the present embodiment, the second joint surface 60 is formed over the entire peripheral edge of the second member 40. Also, the second joint surface 60 is formed over the entire end face of each tubular portion 46.

Operation of the present embodiment will now be described.

Figure 7:
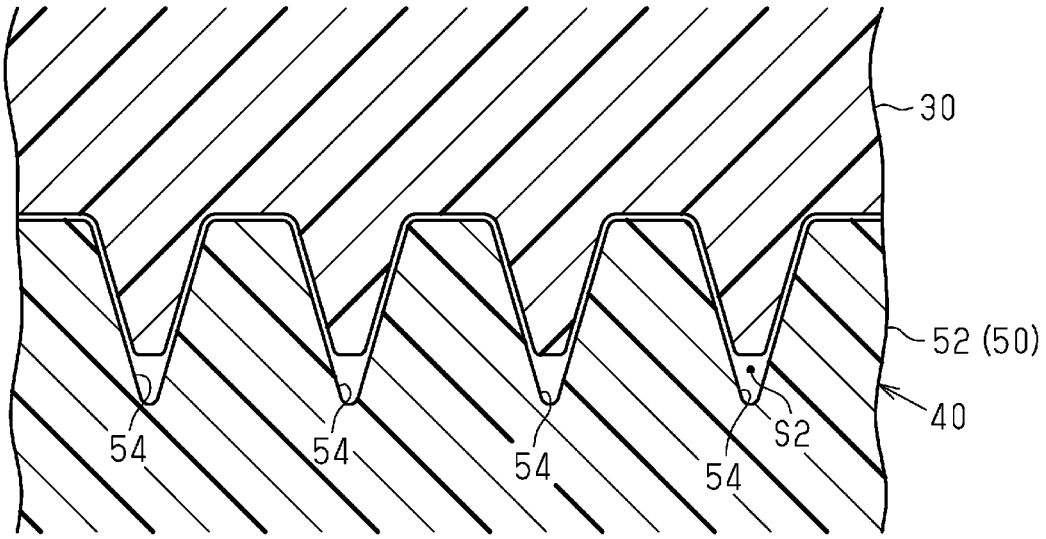
FIG. 7 is a cross-sectional view showing a joined state of a second joint portion of the second member and a first member.
Figure 8:
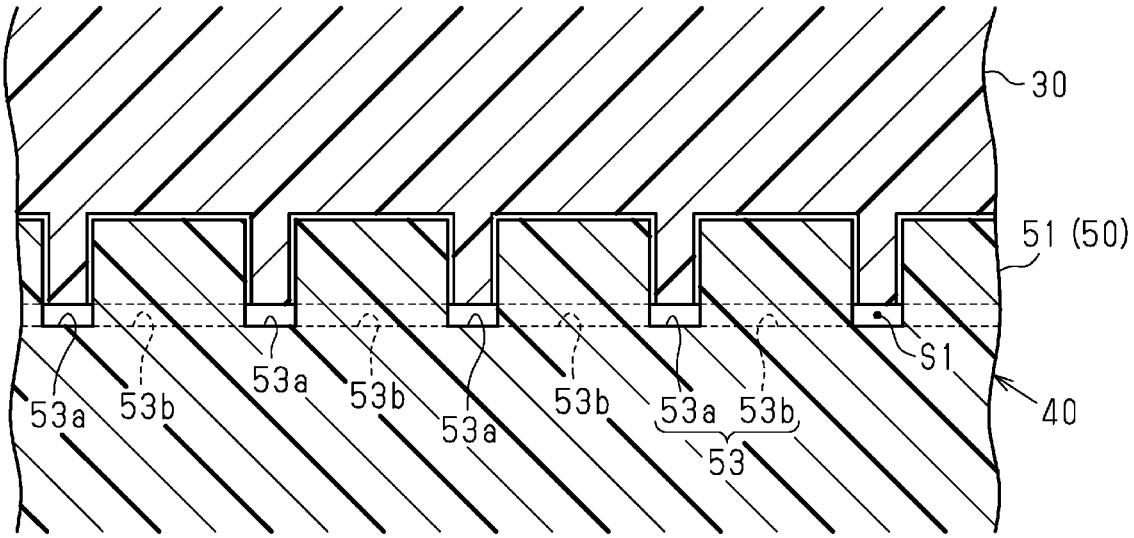
FIG. 8 is a cross-sectional view showing a joined state of a first joint portion of the second member and the first member.

As shown in FIGS. 7 and 8, when the first member 30 is formed by insert molding with the second member 40 as an insert, the recess portion 53 of the first joint portion 51 and the grooves 54 of the second joint portion 52, which are formed in each first joint surface 50 of the second member 40, are filled with molten plastic. Since the recess portion 53 has the shape of a lattice, a large contact area is ensured between the first joint portion 51 and the first member 30. This increases the joint strength between the first member 30 and the second member 40.

When the recess portions 53 of the first joint portions 51 and the grooves 54 of the second joint portions 52 are filled with molten plastic in the chain cover 21, small first gaps S1 and small second gaps S2 are respectively created between the first joint portions 51 and the first member 30 and between the second joint portions 52 and the first member 30. For illustrative purposes, the gaps S1, S2 are partly exaggerated and simplified.

As shown in FIG. 8, the first gaps S1 connect the first grooves 53*a* and the second grooves 53*b* to each other at intersections of the first grooves 53*a* and the second grooves 53*b* in the bottom of the lattice-shaped recess portion 53 (lower portion as viewed in FIG. 8). Thus, for example, if the first joint portion 51 were provided to be closer to the insertion hole 43 than the second joint portion 52, that is, closer to the space adjacent to the peripheral portion 45 than the second joint portion 52, blow-by gas in the internal combustion engine and oil splashed from the engine main body 10 would easily infiltrate from the inner circumference to the outer circumference of the insertion hole 43 through the intersections of the first gaps S1. The infiltrated blow-by gas or oil could reduce the joint strength at the first joint portions 51.

In this regard, the second joint portion 52 of the chain cover 21 according to the present embodiment is closer to the insertion hole 43 than the first joint portion 51. Further, the grooves 54 are arranged along the intersecting direction, which intersects with the extending direction of the peripheral portion 45 about the insertion hole 43. This prevents blow-by gas or oil from infiltrating through the small second gaps S2 between the second joint portion 52 and the first member 30. This is because the second gaps S2, which are formed along the tops and bottoms of the grooves 54 of the second joint portion 52, hinder movement of the blow-by gas and oil. This improves the sealing performance between the first member 30 and the second member 40. Since the sealing performance is improved at the second joint portion 52, blow-by gas or oil are prevented from infiltrating into the first joint portion 51. The joint strength at the first joint portion 51 is thus maintained.

The present embodiment has the following advantages.

(1) The peripheral portion 45 around each insertion hole 43, which is a periphery of the second member 40, includes the first joint surface 50, which is joined to the first member 30. Each first joint surface 50 includes the first joint portion 51, which includes the lattice-shaped recess portion 53, and the second joint portion 52, which includes the grooves 54. The grooves 54 extend in a direction in which the peripheral portion 45, or a periphery, extends, while being arranged in the intersecting direction, which intersects with the extending direction. The second joint portion 52 is provided to be closer to the space adjacent to the peripheral portion 45, which is a periphery, than the first joint portion 51.

This configuration operates in the above described manner. Accordingly, the joint strength and the sealing performance at a joined portion of members made of different materials are improved.

(2) Each first joint surface 50 is formed over the entire corresponding peripheral portion 45, which is a periphery. The first joint surface 50 includes the first joint portion 51 and the second joint portion 52, which extend over the entire peripheral portion 45, which is a periphery.

This configuration improves the joint strength and the sealing performance at a joined portion of members made of different materials.

(3) The first member 30 and the second member 40 include the insertion holes 32, 43, which respectively receive the variable valve timing mechanisms 91, 92. The second member 40 includes the attachment holes 44, which are provided in the peripheral portion 45 about each insertion hole 43, or in the periphery of the second member 40. The attachment holes 44 respectively receive the variable valve timing mechanisms 91, 92. The second member 40 is made of PPS-GF, which satisfies both the condition that a coefficient of linear expansion is lower than that of PA6-GF and the condition that the water absorbency is lower than that of PA6-GF.

The chain cover 21 includes the insertion holes 32, 43, which respectively receive the variable valve timing mechanisms 91, 92. The variable valve timing mechanisms 91, 92 are attached to the attachment holes 44, which are provided in the peripheral portion 45 about each insertion hole 43, or in the periphery of the second member 40. To ensure the positional accuracy of the variable valve timing mechanisms 91, 92, the attachment holes 44 are desired to have material properties that resist deformation due to heat transmitted from the engine main body 10 or collected water.

With the above-described configuration, the second member 40, which includes the attachment holes 44, is made of a material that satisfies both the condition that the coefficient of linear expansion is lower than that of the hard plastic forming the first member 30 and the condition that the water absorbency is lower than that of the hard plastic. This limits deformation of the attachment holes 44 due to heat transmitted from the engine main body 10 or collected water. This prevents the positional accuracy of the mechanisms attached to the attachment holes 44 from decreasing.

(4) The peripheries of the second member 40 are the peripheral portions 45 about the insertion holes 43 of the second member 40.

Since the insertion holes 43 connect the interior and the exterior of the internal combustion engine to each other, the peripheral portions 45 about the insertion holes 43 are always exposed to blow-by gas and oil of the internal combustion engine.

The above-described configuration prevents blow-by gas and oil of the internal combustion engine from infiltrating through the small gaps S1, S2 between the first joint surface 50 of the second member 40 and the first member 30 in the peripheral portions 45 about the insertion holes 43.

<Modifications>

The above-described embodiment may be modified as follows. The above-described embodiment and the following modifications can be combined as long as the combined modifications remain technically consistent with each other.

Each first joint surface 50 does not necessarily need to be provided over the entire peripheral portion 45 about the corresponding insertion hole 43.

The joint surfaces of the present disclosure are not limited to the first joint surfaces 50 formed in the peripheral portions 45 about the insertion holes 43. Further, with reference to FIG. 3, the present disclosure may be employed in part of the second joint surface 60 that is located in a peripheral portion 50A on the back face 41 of the second member 40 or in parts of the second joint surface 60 that are formed in the peripheral portions of the tubular portions 46.

The number and the positions of the fastening holes 34 are not limited to the ones in the above-described embodiment, but may be changed.

The numbers and the positions of the tubular portions 46 of the second member 40 are not limited to the ones in the above-described embodiment, but may be changed.

The tubular portions 46 of the second member 40 may be omitted.

The chain cover 21 is not limited to the one in which only the first member 30 includes the through-hole 33. For example, the second member 40 may include a hole through which the crankshaft 18 extends, so that this hole and the through-hole 33 form a through-hole in the chain cover 21, through which the crankshaft 18 extends.

The second member 40 is not limited to the one made of polyphenylene sulfide (PPS-GF) as described in the above-described embodiment, but may be made of metal such as aluminum in place of PPS. In place of PPS, it is possible to select and use any of the following hard plastics: liquid crystal polymer (LCP), polyether ether ketone (PEEK), polyethylene naphthalate (PEN), polyamide 6T (PA6T), polyamide 9T (PA9T), polyethylene terephthalate (PBT), or polyacetal (POM).

The first member 30 is not limited to the one made of polyamide 6 (PA6-GF) as described in the above-described embodiment, but may be made of a plastic that has polyamide as a major component in place of polyamide 6.

The shapes of the chain cover 21, the first member 30, and the second member 40 are not limited to rectangular shapes in front view as described in the above-described embodiment, but may be changed in accordance with requirements to be met by the chain cover 21 when mounted on the engine main body 10.

The cover according to the present disclosure is not limited to the chain cover 21, but may be a timing belt cover.

The invention claimed is:

1. A cover for an internal combustion engine, the cover being configured to be attached to an engine main body and cover a timing chain or a timing belt, the cover comprising:
- a first member made of a hard plastic; and
- a second member made of a material different from the hard plastic, wherein
- the first member is formed by insert molding with the second member as an insert,
- the second member includes a joint surface in a periphery of the second member, the first member being joined to the joint surface,
- the joint surface includes:
  - a first joint portion that includes a lattice-shaped recess portion; and
  - a second joint portion that includes grooves, the grooves extending in an extending direction in which the periphery extends, and the grooves being arranged in an intersecting direction that intersects with the extending direction, and
- the second joint portion is provided to be closer to a space adjacent to the periphery than the first joint portion.

2. The cover for the internal combustion engine according to claim 1, wherein
- the joint surface is provided over the entire periphery, and
- the first joint portion and the second joint portion are provided over the entire periphery.

3. The cover for the internal combustion engine according to claim 1, wherein
- the first member and the second member each include an insertion hole that receives a mechanism that varies a manner in which an engine valve operates,
- the second member includes an attachment portion provided in a peripheral portion around the insertion hole of the second member, the mechanism being attached to the attachment portion, and
- the second member is made of a material that satisfies at least one of a condition that a coefficient of linear expansion is lower than that of the hard plastic or a condition that a water absorbency is lower than that of the hard plastic.

4. The cover for the internal combustion engine according to claim 3, wherein the periphery of the second member is a periphery about the insertion hole of the second member.

* * * * *